US005425260A

United States Patent [19]

Gehron

[11] Patent Number: 5,425,260

[45] Date of Patent: Jun. 20, 1995

[54] ACCIDENT RESCUE TOOL

[76] Inventor: Michael A. Gehron, 777 Mariclaire Ave., Vandalia, Ohio 45377

[21] Appl. No.: 187,292

[22] Filed: Jan. 27, 1994

[51] Int. Cl.[6] ..... B21D 1/12

[52] U.S. Cl. ..... 72/301; 72/705

[58] Field of Search ..... 72/705, 457, 447, 301, 72/298; 254/93 R

[56] References Cited

U.S. PATENT DOCUMENTS

| | | | |
|---|---|---|---|
| 3,149,659 | 9/1964 | Bogert, Jr. | 153/32 |
| 3,556,482 | 1/1971 | Whitney | 254/134 |
| 3,583,203 | 6/1971 | Williams | 72/446 |
| 3,719,347 | 3/1973 | Wolgast et al. | 254/124 |
| 3,819,153 | 6/1974 | Hurst et al. | 254/93 |
| 3,891,187 | 6/1975 | Bearden, Jr. | 254/93 |
| 3,985,014 | 10/1976 | Smith | 72/457 |
| 4,088,006 | 5/1978 | Patten | 72/457 |
| 4,732,029 | 3/1988 | Bertino | 72/301 |

*Primary Examiner*—Lowell A. Larson
*Assistant Examiner*—Rodney A. Butter
*Attorney, Agent, or Firm*—Biebel & French

[57] ABSTRACT

An accident rescue tool is disclosed having a base, a base arm fixedly attached to the base, and a lifting arm pivotably attached to the base. In addition, means for pivoting the lifting arm toward the base arm is provided, as is a first chain connected to the base arm at one end and a rigid vehicle component at the other end and a second chain connected to the lifting arm at one end and a vehicle component at the second end. The pivoting means is connected to both the base arm and lifting arm to pivot the lifting arm so that the second chain causes the vehicle component to move in conjunction herewith.

16 Claims, 3 Drawing Sheets

ACCIDENT RESCUE TOOL

BACKGROUND OF THE INVENTION

1. Field of the Invention

The present invention relates to an accident rescue tool, and, more particularly, to an accident rescue tool operable either as a sole unit or in conjunction with rescue tools for applying high magnitude push/pull forces.

2. Description of Related Art

As is well-known, a large number of vehicle accidents occur and due to the speeds of the vehicles and the strength of materials in automotive designs, they can result in one or more of the occupants of the vehicle being trapped inside of the vehicle wreckage.

U.S. Pat. No. 3,819,153, to Hurst, discloses one currently existing and used rescue tool known as the "JAWS OF LIFE". This rescue tool utilizes a pair of pivotally interconnected arms or jaws in conjunction with means for forcibly opening and closing the jaws by hydraulic, pneumatic, electrical or other means, so that when the jaws are applied to a wrecked vehicle, various parts thereof can be either pushed, pulled, divided or separated so that access to the interior of the vehicle is possible. The actuated force means to pivot the arms toward or away from one another, as desired, are incorporated in such tools.

Unfortunately, many vehicle accidents result in badly mangled or bent vehicle body portions and the vehicle driver usually has the steering wheel impacted against his body. This causes problems and difficulty in freeing the driver from the vehicle. Heretofore, known devices and/or other tools, such as crowbars and the like, have been used to remove a door, remove a wheel, or remove the car to present a more favorable attitude for use of the tools. The JAWS OF LIFE, while having a high degree of success in many accident situations, has encountered problems in use for badly mangled or disposed vehicles. This mangling and/or disposition of the vehicle very substantially affects the use of the tools and access to the vehicle occupants.

As shown in FIG. 2 of U.S. Pat. No. 3,819,153, for example, a present method of operation of using the JAWS OF LIFE tool is to break open the windshield, if this has not already occurred, and utilize the hydraulically operated arms connected to chains to pull the steering and column through the windshield opening. It has been found that frequently the condition or position of the wrecked vehicle is such that the length of time required to move parts of the vehicle, and especially an impacted steering wheel, are time consuming and may require several steps or individual operations. It is also known that the previous device requires a point of attachment of one of the chains, that is the end of a chain, so that the tool can be activated in an appropriate manner.

One device which is intended to overcome these problems is disclosed in U.S. Pat. No. 4,732,029, to Bertino. This tool consists of telescopic arms, a roller on a free end of one arm and a fixed roller on a free end of the other arm, where the arm combination is rigid in its use. This tool is adapted for support of two chains which are movably supported by and coactive with the rollers on the arm ends. Most importantly, as the chains are brought together, the operating means for doing so causes the arms to telescope and, in conjunction therewith, the chains move a component of the vehicle with respect thereto.

while the accident rescue tool of Bertino assists in overcoming some of the shortcomings found in utilizing the JAWS OF LIFE tool, it has been found that such a rescue tool oftentimes causes the front end of a vehicle to compact during operation rather than move the steering column. In addition, it has been found that utilization of the Bertino and other prior art devices oftentimes requires the skill of two or more people which also increases the time required for fulfilling the operation.

Accordingly, a primary object of the present invention is to provide an accident rescue tool which minimizes the amount of time and manpower required for operation.

Another objective of the present invention is to provide an accident rescue tool which minimizes compression of a vehicle front end during operation.

Yet another objective of the present invention is to provide an accident rescue tool which has the flexibility to accommodate use in varying positions on a vehicle.

These objectives and other features of the present invention will become more readily apparent upon reference to the following description when taken in conjunction with the following drawing.

SUMMARY OF THE INVENTION

In accordance with one aspect of the present invention, an accident rescue tool is disclosed having a base, a base arm fixedly attached to the base, and a lifting arm pivotably attached to the base. In addition, means for pivoting the lifting arm toward the base arm is provided, as is a first chain connected to the base arm at one end and a rigid vehicle component at the other end and a second chain connected to the lifting arm at one end and a vehicle component at the second end. The pivoting means is connected to both the base arm and lifting arm to pivot the lifting arm so that the second chain causes the vehicle component to move in conjunction herewith.

BRIEF DESCRIPTION OF THE DRAWINGS

While the specification concludes with claims particularly pointing and distinctly claiming the present invention, it is believed that the same will be better understood from the following description taken in conjunction with the accompanying in which:

DETAILED DESCRIPTION OF THE PREFERRED EMBODIMENT

Figure 1:
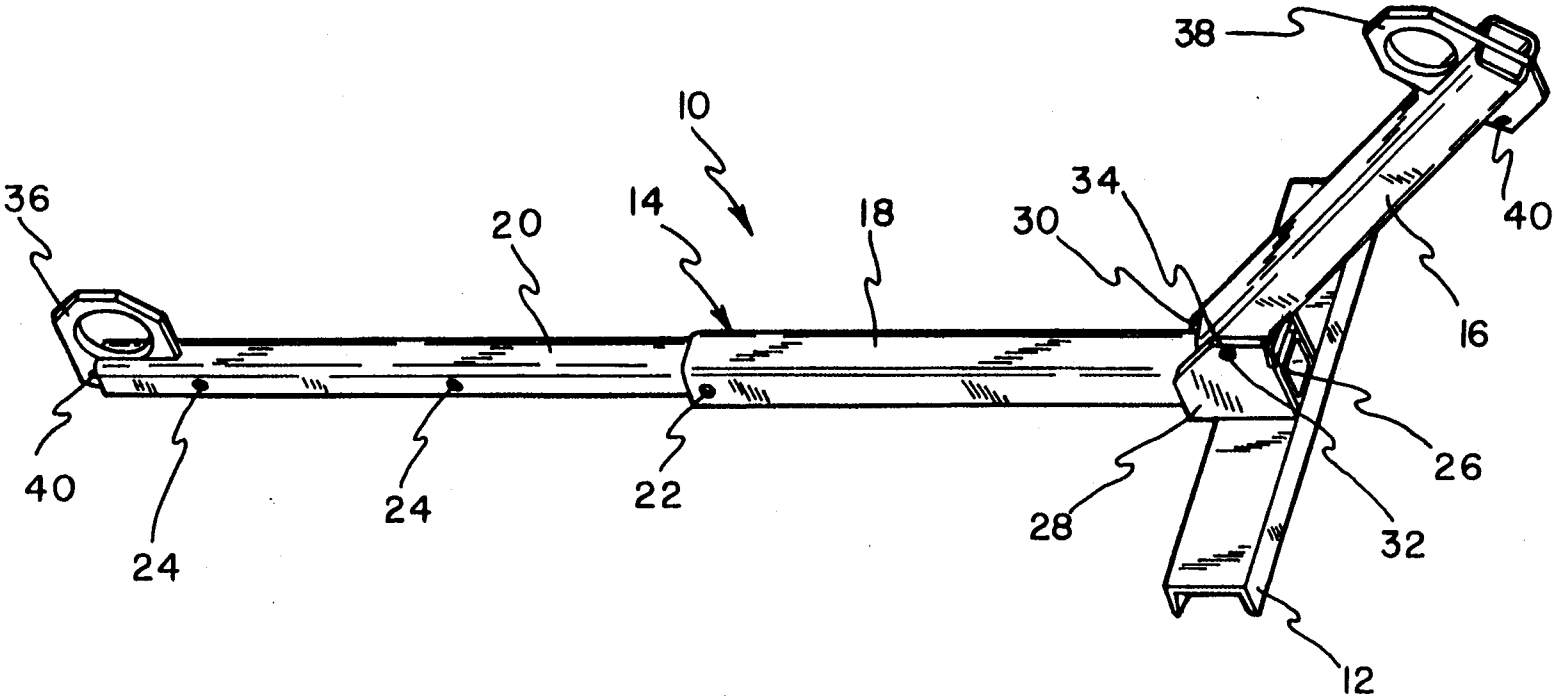
FIG. 1 is a perspective view of the accident rescue tool of the present invention.

Referring now to the drawings in detail, wherein identical numerals indicate the same elements throughout the figures, FIG. 1 depicts an accident rescue tool 10 including a base 12. Base 12 is depicted as rectangular in design, but may be any of a variety of shapes. Accident rescue tool 10 also includes a base arm 14 fixedly attached to base 12 and a lifting arm 16 pivotably attached to base 12. It will be seen that base arm 14 preferably includes a first member 18 which is that portion of base arm 14 fixedly attached to base 12 and a second member 20 which is telescopically interactive with first member 18. In this way, base arm 14 may be adjusted to varying lengths depending upon the application. In order to assure the proper positioning of members 18 and 20, a hole 22 is provided in member 18 and several spaced holes 24 are located in member 20, whereby a pin (not shown) or other means is inserted through hole 22 and a desired hole 24 to lock members 18 and 20 in position. It will also be noted that a stop 26 is provided between parallel hinge plates 28 and 30 in order to prevent pivoting or rotating movement by base arm 14.

Lifting arm 16 is pivotably attached to base 12 by means of hinge plates 28 and 30, where holes 32 are provided therein and a pin 34 is inserted therethrough. Of course, holes (not shown) are provided in lifting arm 16 for pin 34 to penetrate lifting arm 16. Preferably, base arm 14 and lifting arm 16 are constructed of steel tubing. It will also be noted that base arm 14 and lifting arm 16 include eyes 36 and 38, respectively, which are welded or otherwise attached thereto. Eyes 36 and 38 may be utilized to attach a means for pivoting lifting arm 16, and may also include holes 40 therein in which the hooks of chains may be attached thereto.

Figure 2:
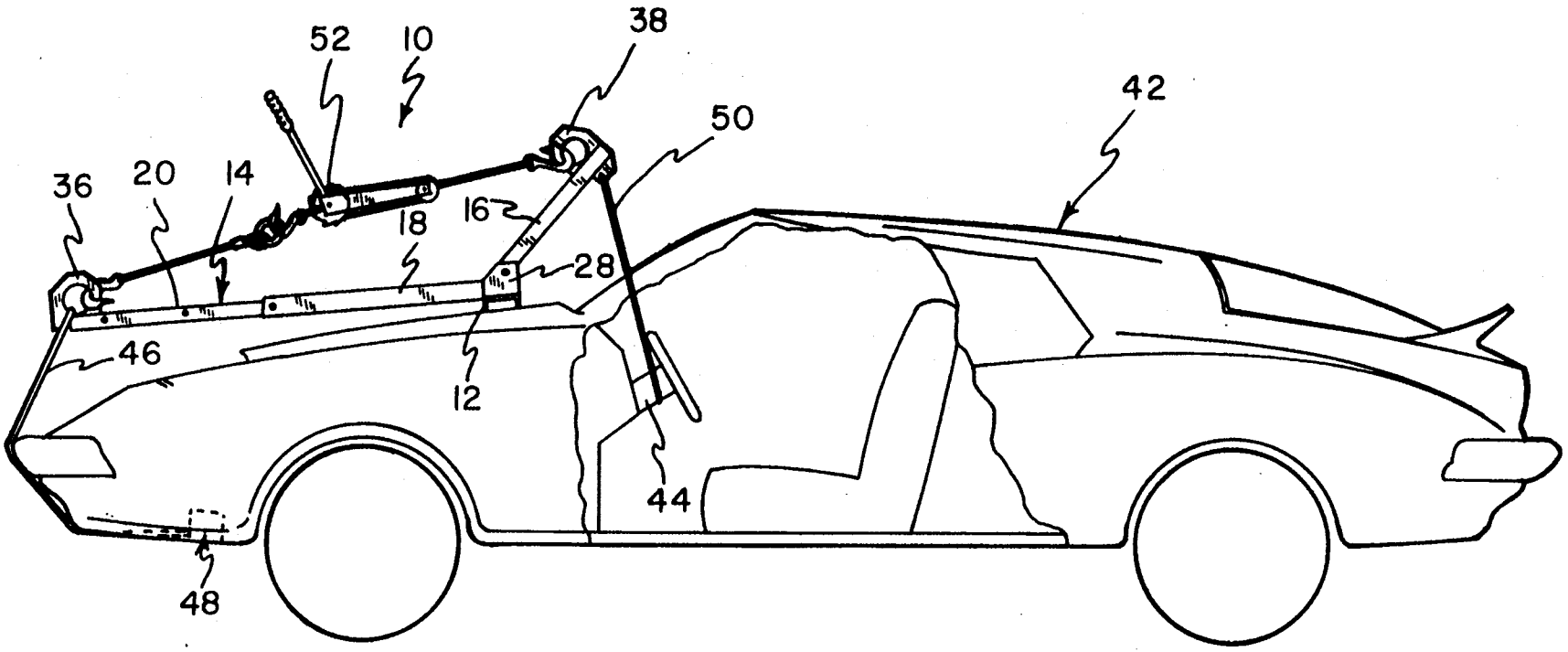
FIG. 2 is a plan view of the accident rescue tool of FIG. 1 as applied to an automobile.

As seen in FIG. 2, accident rescue tool 10 of the present invention is positioned on a vehicle 42 in order to move or bend a steering wheel column 44. A first chain 46 is attached to base arm 14 at one end and preferably to a rigid vehicle component 48 (e.g., a frame member) at the other end. A second chain 50 is attached at one end to lifting arm 16 and at a second end to steering wheel column 44. In order to move the steering wheel column 44, means 52 for pivoting lifting arm 16 toward base arm 14 is provided. Pivoting means 52 may be an item as simple as a come-along. Alternatively, the JAWS OF LIFE may be used as pivoting means 52, whereby the two pivotably mounted arms thereof are interconnected at their free ends with base arm 14 and lifting arm 16 so that when the arms of the JAWS OF LIFE are closed, they pivot lifting arm 16 about base 12 which results in movement of steering column 44. Accordingly, as opposed to other devices of the prior art, accident rescue tool 10 is able to utilize the leverage of base arm 14. Because base arm 14 is maintained in a substantially constant plane, any collapsing or crushing of the front end of vehicle 42 is minimized during operation of accident rescue tool 10.

Further, it will be understood that the accident rescue tool 10 may be utilized to perform the rescue operation by only one person as opposed to several. The time for operating accident rescue tool 10 is also significant, in that the time for moving steering wheel column 44 and extracting a person trapped thereby is reduced. It has been found that such an operation can be performed in as little as three to four minutes.

Figure 3:
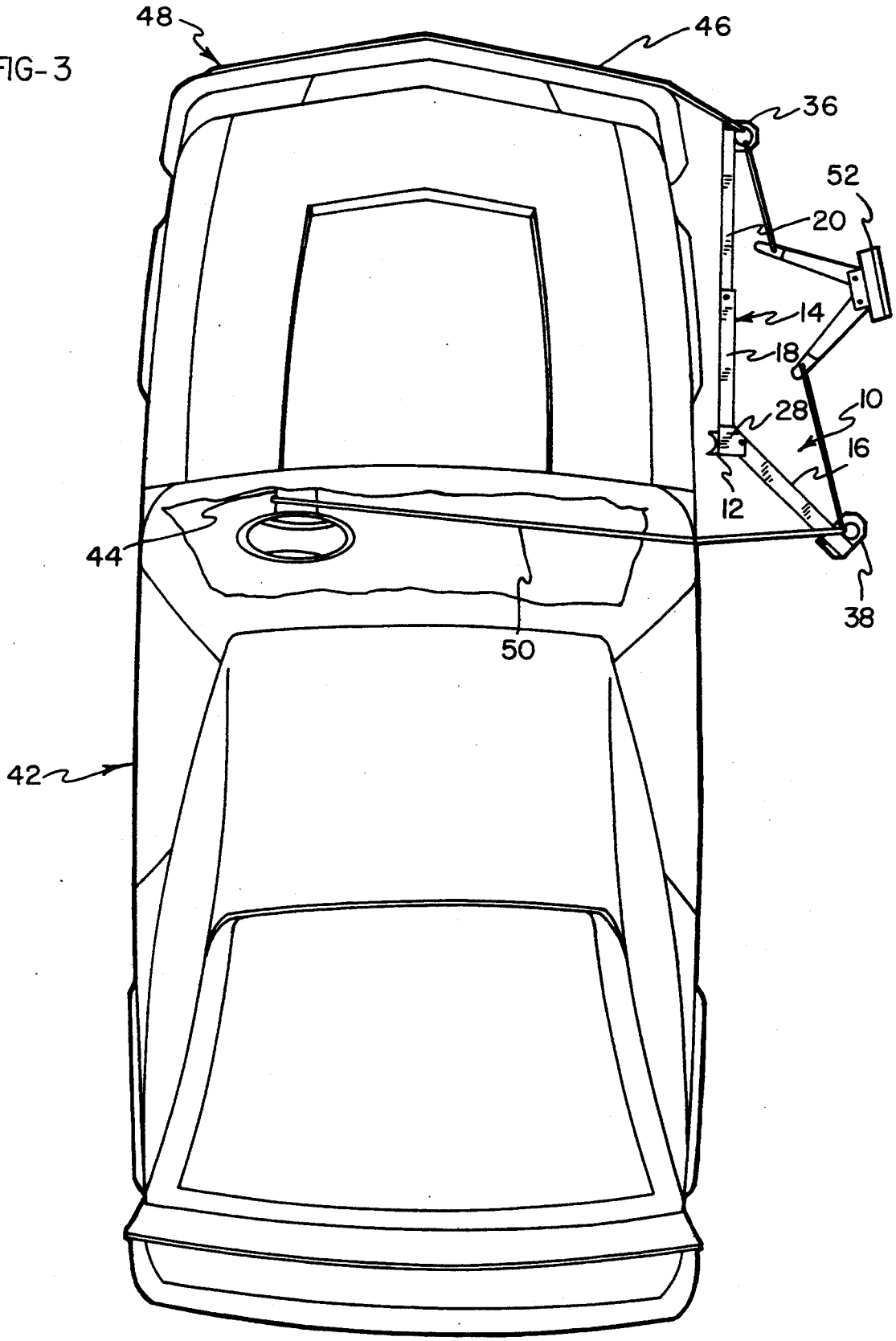
FIG. 3 is a top view of the present invention as applied to the side of an automobile.

Another advantage of the present invention is the ability to utilize accident rescue tool 10 in varying positions about a vehicle. For example, as seen in FIG. 3, accident rescue tool 10 is positioned along a side of vehicle 42 by positioning base 12 about a side panel or chassis. First chain 46 is attached to a rigid vehicle component and second chain 50 is attached to steering wheel column 44. Accordingly, when accident rescue tool 10 is operated, it causes second chain 50 to pull steering wheel column 44 in a sideways direction. It will be seen then that base 12 may be positioned on a surface of vehicle 42 either in a horizontal plane different from the vehicle component to be moved (FIG. 2) or it may be positioned in a horizontal plane approximately the same as the vehicle component to be moved (FIG. 3).

Having shown and described the preferred embodiment of the present invention, further adaptations of the accident rescue tool can be accomplished by appropriate modifications by one of ordinary skill in the art without departing from the scope of the invention.

For example, as can be seen from FIGS. 2 and 3, base 12 of accident rescue tool 10 can be positioned in a number of locations on a vehicle 42 in order to promote the desired movement of a vehicle component.

What is claimed is:

1. An accident rescue tool for use with a vehicle, comprising:

(a) a base;

(b) a base arm fixedly attached to said base, wherein a first chain is affixed at one end to said base arm and at a second end to a rigid vehicle component;

(c) a lifting arm pivotably attached to said base, wherein a second chain is affixed at one end to said lifting arm and at a second end to a vehicle component; and (d) means for pivoting said lifting arm toward said base arm, said second chain causing said vehicle component to move in conjunction therewith.

2. The accident rescue tool of claim 1, said base arm further comprising a first member fixedly attached to said base and a second member telescopically interactive with said first member, wherein said base arm may be adjusted for varying lengths.

3. The accident rescue tool of claim 1, said base arm and said lifting arm each including eyes attached thereto, wherein said pivoting means is connected to said eyes.

4. The accident rescue tool of claim 1, wherein said base arm and said lifting arm is made of steel tubing.

5. The accident rescue tool of claim 1, said base including a stop to prevent rotation by said base arm.

6. The accident rescue tool of claim 1, further comprising first and second hinge plates attached to said base, said hinge plates being spaced apart in parallel orientation to each other with said lifting arm positioned therebetween, said hinge plates and said lifting arm each having a hole therein, and a pin which is inserted through all of said holes, whereby said lifting arm is pivotable about said base.

7. The accident rescue tool of claim 1, wherein said pivoting means is a come-along.

8. The accident rescue tool of claim 1, said pivoting means including two pivotally mounted arms interconnected at their free ends with said base arm and said lifting arm, the closure of said pivoting means arms serving to pivot said lifting arm about said base and resulting in movement of said vehicle component.

9. The accident rescue tool of claim 1, wherein said rigid vehicle component is a frame member of said vehicle.

10. The accident rescue tool of claim 1, wherein said vehicle component is a steering column of said vehicle.

11. The accident rescue tool of claim 1, wherein said base is positioned on a surface of said vehicle in a horizontal plane different than that of said vehicle component.

12. The accident rescue tool of claim 1, wherein said base is positioned on a surface of said vehicle horizontally coplanar with said vehicle component.

13. The accident rescue tool of claim 1, wherein said base is a rectangular member oriented perpendicularly to said base arm.

14. An accident rescue tool for use in forcibly moving a vehicle steering wheel column from a restraining position against an occupant of a damaged vehicle, comprising:

(a) a base adapted for placement in selective fixed areas of the vehicle;

(b) a base arm fixedly attached to said base, wherein a first chain is affixed at one end to said base arm and at a second end to a rigid component of said vehicle;

(c) a lifting arm pivotably attached to said base, wherein a second chain is affixed at one end to said lifting arm and at a second end to said vehicle steering wheel column; and (d) means for pivoting said lifting arm toward said base arm, wherein said second chain causes said vehicle steering wheel column to move in conjunction therewith.

15. The accident rescue tool of claim 14, wherein said base arm is adjustable for varying lengths.

16. The accident rescue tool of claim 14, said pivoting means including two pivotally mounted arms interconnected at their free ends with said base arm and said lifting arm, wherein said arms of the pivoting means serve to pivot said lifting arm about said base upon closure thereof.

* * * * *